United States Patent [19]

Bivona et al.

[11] Patent Number: 4,867,121

[45] Date of Patent: Sep. 19, 1989

[54] PISTON SYSTEM FOR USE IN AN INTERNAL COMBUSTION ENGINE

[76] Inventors: Steve Bivona; John Bivona, both of 9 Stoney Brook Rd., Norwalk, Conn. 06851

[21] Appl. No.: 119,670

[22] Filed: Nov. 12, 1987

[51] Int. Cl.[4] ..... F02F 1/10

[52] U.S. Cl. ..... 123/197 A; 123/193 P; 92/89

[58] Field of Search ..... 123/193 R, 193 P, 197 A, 123/18 A; 92/89

[56] References Cited

U.S. PATENT DOCUMENTS 4,044,728 8/1977 Moeller ..... 123/193 R
4,453,508 6/1984 Groeger ..... 123/193 R
4,651,690 3/1987 Yang ..... 123/193 R

FOREIGN PATENT DOCUMENTS 0973922 11/1982 U.S.S.R. ..... 92/89

*Primary Examiner*—David A. Okonsky
*Attorney, Agent, or Firm*—Perman & Green

[57] ABSTRACT

A piston system for use in an internal combustion engine comprises a flexible piston disposed adjacent a combustion chamber of the engine and a piston drive means movably disposed adjacent the flexible piston such that the drive means can deform the flexible piston of the engine and combustion in the combustion chamber can force the flexible piston to move the drive means.

21 Claims, 4 Drawing Sheets

PISTON SYSTEM FOR USE IN AN INTERNAL COMBUSTION ENGINE

BACKGROUND OF THE INVENTION

1. Field of the Invention

This invention relates to internal combustion engines and, more particularly, to a piston system having a flexible piston.

2. Prior Art

Internal combustion engines in the past can generally be classified into three main categories; two and four stroke gasoline engines, diesel engines and rotary piston engines. However, numerous problems have been presented with the prior art. Such problems include, but are not limited to, the conversion of motion, free inertial forces, sealing, relatively expensive and complicated manufacturing, relatively expensive and complicated replacement of parts.

It is an objective of the present invention to provide a new form of internal combustion engine having a flexible piston system.

It is a further objective of the present invention to provide a new type of piston system for use in prior art internal combustion engines.

It is a further objective of the present invention to provide an internal combustion engine which is relatively simple in design.

It is a further objective of the resent invention to provide an internal combustion engine which allows for the relatively simple and inexpensive replacement of parts.

It is a further objective of the present invention to provide an internal combustion engine which allows for the relatively simple and inexpensive manufacture thereof.

SUMMARY OF THE INVENTION

The foregoing problems are overcome and other advantages are provided by a piston system for use in an internal combustion engine. The system has a flexible piston means for use in driving the engine.

In accordance with one embodiment of the invention, a piston system is provided for use in an internal combustion engine. The piston system has a flexible piston means disposed with a combustion chamber of the engine and a drive means cooperating therewith such that the drive means can deform the flexible piston means during the compression cycle of the engine for compression of the fuel mixture and subsequent combustion thereof.

In accordance with an alternate embodiment of the invention, an internal combustion engine is provided which has a housing means having a combustion chamber means, a fuel inlet means and a gas exhaust means. A drive means is provided which is mounted, at least partially, in the housing means and has a piston drive means connected thereto. An elastic piston means is disposed in the housing means adjacent the combustion chamber means. The elastic piston means is capable of being deformed by the piston drive means and enables the combustion chamber means to vary in size whereby the piston drive means can deform the piston means during the compression cycle of the engine.

In accordance with another embodiment of the invention, an internal combustion engine is provided with a housing means having an internal working chamber, the chamber has a first relatively oval shaped center portion and two second end portions. Fuel inlet means and gas exhaust means are provided which communicate with the second end portions of the working chamber. Flexible piston means are disposed in the working chamber and comprise at least two relatively thin flexible plates each having two opposite end portions located proximate the chamber second end portions. Cam shaft means is rotatably mounted in the working chamber between the two plates and is capable of deforming the plates. Piston contact valve means are also located proximate the plates in the chamber between the chamber center portion and the chamber second end portions.

In accordance with one method of the invention, a method of powering an internal combustion engine comprises the steps of inleting fuel mixture into a combustion chamber of the engine, the engine having a piston means made of a relatively flexible material; deforming the piston means from a home position to a combustion position thereby decreasing the volume of the combustion chamber and compressing the fuel mixture; and combusting the fuel mixture in the combustion chamber.

DETAILED DESCRIPTION OF THE INVENTION

Figure 1:
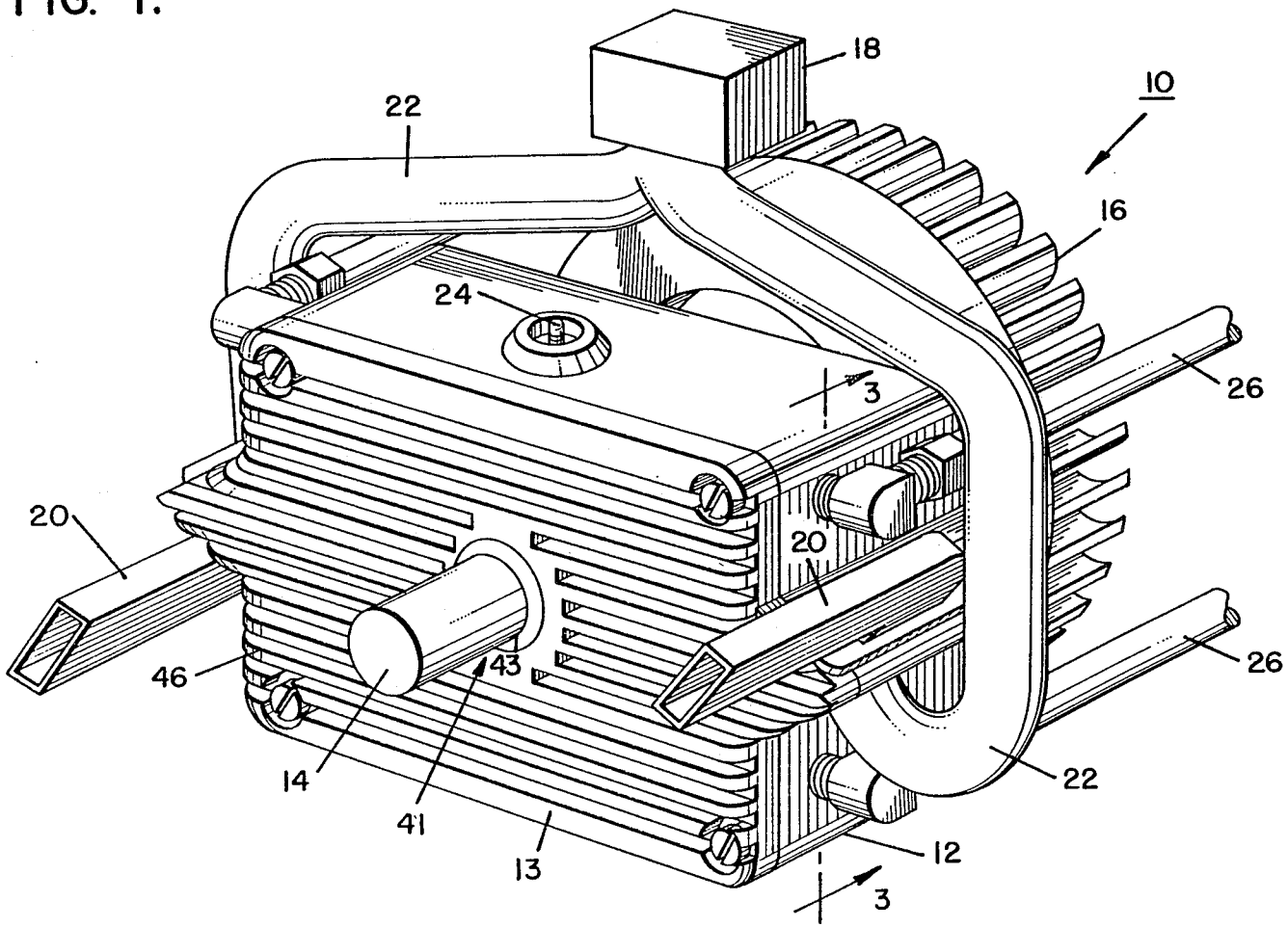
FIG. 1 is a perspective view of one embodiment of an internal combustion engine incorporating features of the invention.

Referring to FIG. 1, there is shown a perspective view of one embodiment of an internal combustion engine 10 incorporating features of the invention. While the following description is with reference to the embodiments shown in the drawings, it should be understood that the present invention is capable of use in various forms, in various types of engines and in varying methods of use. In addition, any suitable size or shape elements can be used and the invention can be combined with various accessories and efficiency devices.

In the embodiment shown, the engine 10 generally comprises an engine block 12, a drive shaft 14, a flywheel 16, a fuel system 18, exhaust system 20, fuel inlet conduits 22, combustion ignition means 24 and engine cooling means 26. The aforementioned elements of the engine 10 are generally known in the art and; therefore, the features of these elements will not be discussed in detail except where necessary to explain the present invention. However, it should be understood that all variations of these prior art elements can be used with the present invention.

Figure 2:
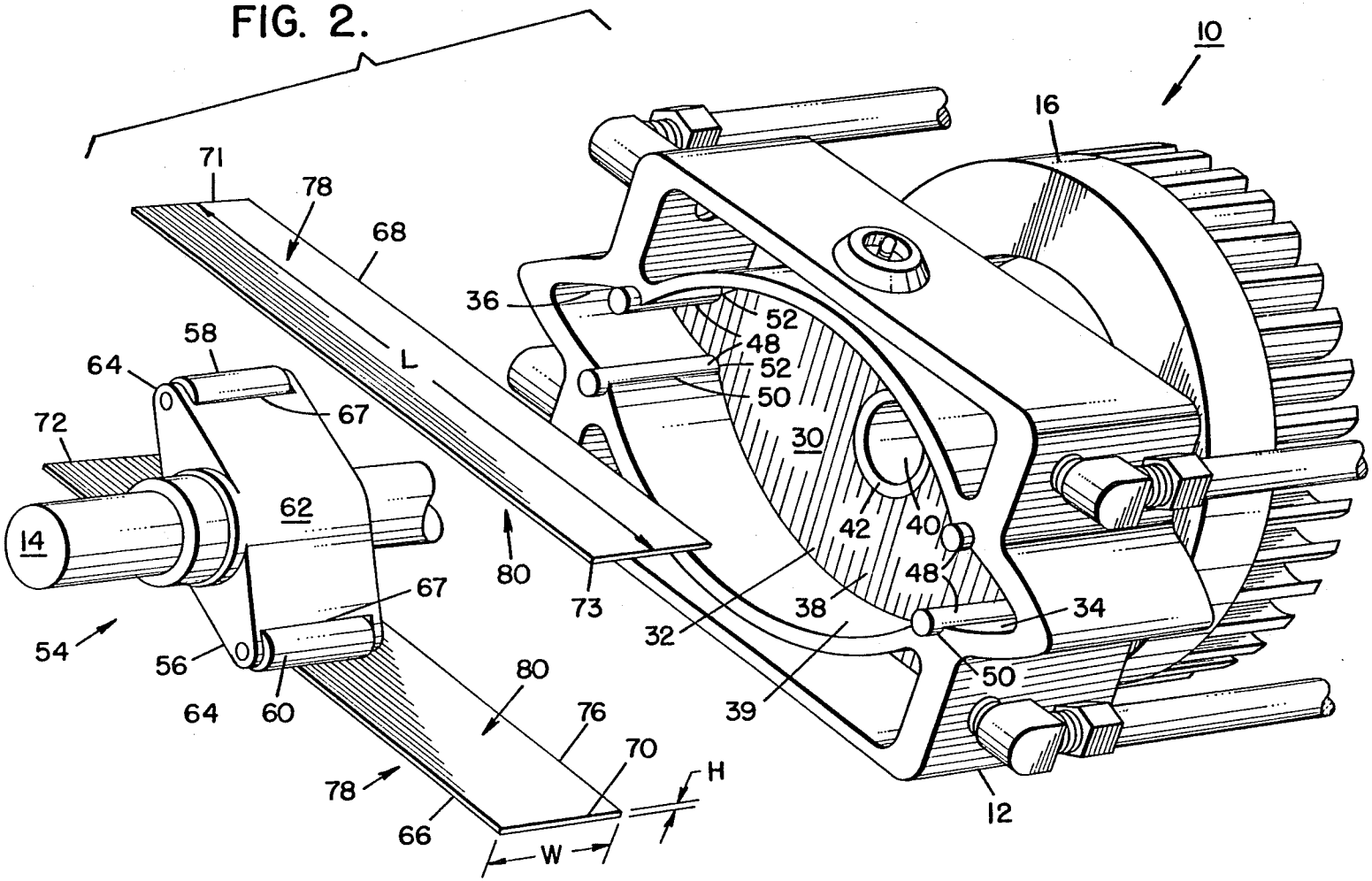
FIG. 2 is a partial exploded view of the engine shown in FIG. 1.

Referring also to FIG. 2, a partial exploded view of the engine 10 is shown. The engine 10, in this embodiment, is generally a two stroke engine having two combustion chambers 90 and 92 (see FIG. 3). However, the present invention can be used in a four stroke engine. In addition, the present invention may have any suitable number of combustion chambers. In this embodiment, the engine block 12 has an interior chamber 30 which has a relatively oval shaped center portion 32, a first end portion 34 and a second end portion 36. Mounted to the engine block 12 is an engine block cover 13 which, at least partially, encloses the interior chamber 30 such that the chamber 30 has a first side 38 formed by the engine block 12, a second side 37 (See FIG. 6), formed by the interior face of the engine block cover 13, and chamber walls 39 therebetween.

Figure 6:
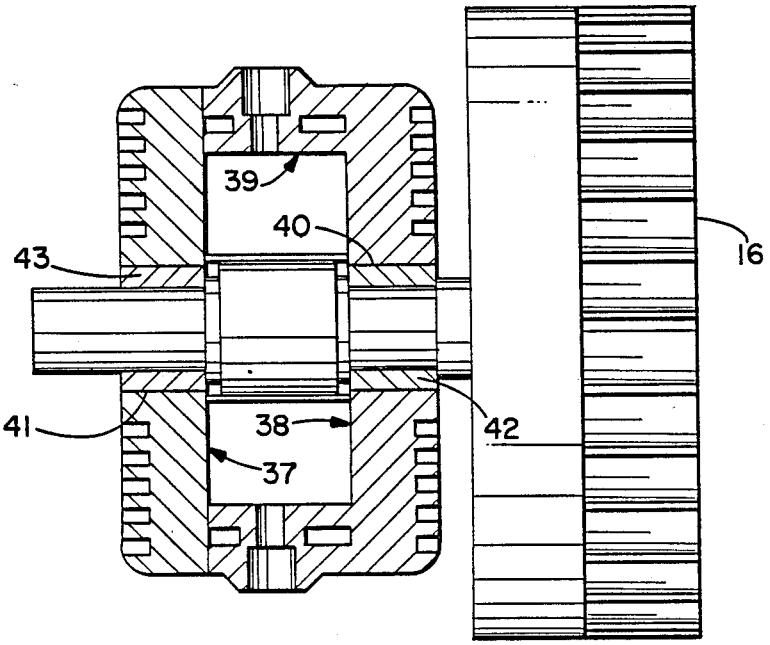
FIG. 6 is a partial cross-sectional view of the engine in FIG. 3 taken along line 6—6.

In the embodiment shown, and as also shown in FIG. 6, the first and second sides 38 and 37 of the chamber 30 are relatively flat and smooth for reasons discussed below. A first shaft aperture 40 is provided in the block 12 through the first side 38. A second shaft aperture 41 is also provided in the cover 13. First and second shaft bearings 42 and 43, are provided in the first and second shaft apertures 40 and 41 for mounting with the shaft 14 and to allow for axial rotation thereof relative to the block 12 and cover 13.

Located in the interior chamber 30 are four contact valves 48. The contact valves 48, in this embodiment, have a general cylindrical shape and are preferably made of an hard abrasion resistant metal alloy or the like. In this embodiment, the contact valves 48 are held in a stationary position relative to the block 12. Although permanently fixed valves may be provided, in this embodiment, the valves 48 are removable for such purposes as cleaning or replacement. To retain the valves 48 in their proper position and also to provide for a proper valve seal, the block 12 is provided with a seat 50 for each contact valve 48. The seats 50 are semi-cylindrical to accommodate the cylindrical shape of the contact valves. However, any suitable cooperative shape could be provided. Located in the first side 38 of the interior chamber 30 and the second side 37 (not shown) of the cover 13 are contact valve indents 52 for further holding of the contact in a secure position and to provide proper sealing. As shown in this embodiment, the contact valves 48 are preferably located at the junctions between the first and second end portions 34 and 36 of the interior chamber 30 and the center portion 32 of the interior chamber for reasons as will be discussed below. Although the present invention is described in use with contact valves 48, any suitable type of valve can be used.

Figure 3:
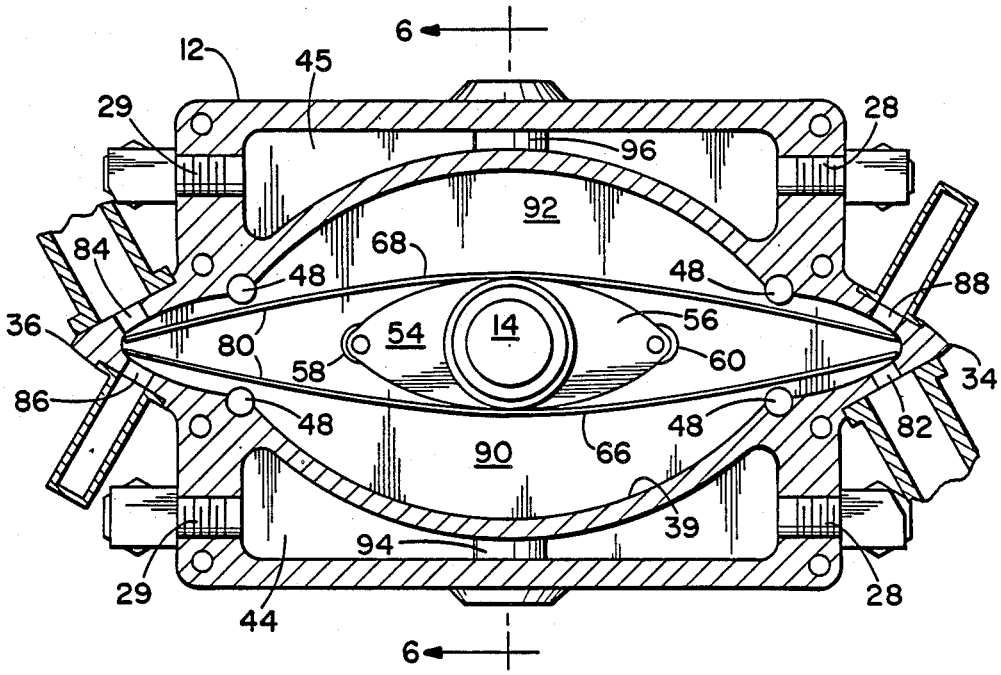
FIG. 3 is a cross-sectional view of the engine shown in FIG. 1 taken across line 3—3 with the piston members and cam/crank assembly in a home position.

Referring also to FIG. 3, a cross-sectional side view taken along lines 3—3 of the engine of FIG. 1 is shown.

The block 12 is provided, in this embodiment, with two fuel mixture input apertures 82 and 84. The input apertures 82 and 84 are generally communicate with the first and second end portions 34 and 36, respectively. The input apertures 82 and 84 allow fuel mixture to be entered into the combustion chambers 90 and 92 of the engine 10 from the fuel system 18 as will be discussed below. The block 12 is also provided with two exhaust apertures 86 and 88 at the first and second end portions 34 and 36, respectively. The exhaust apertures allow combusted fuel and gases to exit the combustion chambers 90 and 92 of the engine 10 via the exhaust system 20 as will be discussed below. As shown in this embodiment, the first input aperture 82 is located in a bottom portion of the first end portion 34 and the first exhaust aperture 86 is located in a bottom portion of the second end portion 36. The second input aperture 84 is located in a top portion of the second end portion 36 and the second exhaust aperture 86 is located in a top portion of the first end portion 34. The exhaust apertures 86 and 88, in turn, are connected to the exhaust system 20 and the input apertures 82 and 84, in turn, are connected to the fuel system 18. Thus, as will be further highlighted below, the engine has two oppositely directed flow paths; a first flow path from the first input aperture 82 through the first combustion chamber 90 and the exhaust aperture 88 and a second flow path from the second input aperture 84 through the second combustion chamber 92 and the second exhaust aperture 86.

In the embodiment shown, separate interior cooling channels 44 and 45 are provided in the engine block 12 such that a coolant can be introduced into the block 12 through a first set of conduits 28, pass through the engine block absorbing heat and exit the block via a second set of conduits 29 as known in the art. In addition, cooling fins 46 are provided on the block 12 and cover 13 to cool the engine 10. However, any suitable cooling means can be provided. Ignition means conduits 94 and 96 are provided in the block 12 to house a portion of the ignition means and providing access to the interior chamber 30 and the combustion chambers 90 and 92 formed therein.

Fixedly mounted to the shaft 14 in the interior chamber 30, in this embodiment is a cam/crank assembly 54. The assembly 54 generally comprises a cam member 56 and two rotatably mounted roller bearings 58 and 60. However, any suitable assembly could be used with the present invention. The cam member 56, in this embodiment, has a generally oval or diamond shaped profile with two relatively gradual curved portions 62 located relatively close to the center of axis of the shaft 14 and two relatively sharp curved outer portions 64 located relatively far from the center of axis of the shaft 14. Located at each of the two outer portions 64 is a roller bearing seat 67. The roller bearings 58 and 60 are generally rotatably mounted in the seats 67 on the cam member 56 and can be removably mounted for easy replacement or service. As shown, a portion of the roller bearings 58 and 60 extend past the curved outer portions 64 of the cam member 56 for contact with piston members 66 and 68.

In this embodiment, the engine 10 has two relatively flexible piston members 66 and 68. The piston members 66 and 68 are generally made of a flexible and relatively resilient material which is capable of repeated elastic flexure, can withstand the heat generated in the combustion chambers 90 and 92 and the force exerted from combustion, such as spring steel.

One preferable type of material is stainless spring tempered 300 series pure steel. However, any suitable flexible material can be used. Each piston member 66 and 68, in this embodiment, is generally rectangular in shape having a relatively small height H, a relatively long length L and a width W sized for proper use in the interior chamber 30 of the engine 10. The first piston member 66 has a first end 70 located in the first end portion 34 and a second end 72 located in the second end portion 36. The second piston member 68 has a first end 71 located in the second end portion 36 and a second end 73 located in the first end portion 34. The piston members 66 and 68 also have a third end 74 and a fourth end 76 with generally abuts against or is in close proximity with the sides of the interior chamber 30 formed by the first side 38 of the block 12 and the interior face 37 (see FIG. 6) of the cover 13. In this embodiment, the piston members 66 and 68 are substantially identical. However, in alternate embodiments various sizes and shapes could be used.

The piston members 66 and 68 are located, in this embodiment, on opposite sides of the cam/crank assembly 54. A first side 78 of the piston members 66 and 68 generally faces the walls 39 of the interior chamber 30 and a second side 80 of the piston members 66 and 68 generally face each other with the assembly 54 located therebetween. The width W of the piston members 66 and 68, in this embodiment, is substantially equal to the width of the interior chamber 30. However, the width W of the piston members may be slightly larger than the width of the interior chamber 30 such that the piston members are slightly compressed to provide proper sealing between the piston members 66 and 68 and the sides of the interior chamber 30. Alternatively, alternate means can be provided to form a seal between the piston members 66 and 68 and the sides of the interior chamber 30.

The embodiment shown in FIGS. 3 and 6 is generally referred to as the home position. As shown, the two piston members 66 and 68 are slightly flexed or bowed. The first piston member 66 has its first end 70 in contact with the wall 39 of the interior chamber 30 in the first end portion 34 and its second end 72 in contact with the wall 39 of the interior chamber 30 in the second end portion 36. The second piston member 68 has its first end 71 in contact with the wall 39 of the interior chamber 30 in the second end portion 36 and its second end 73 in contact with the wall 39 of the interior chamber 30 in the first end portion 34. A portion of each piston member's second side 80 is in contact with the slightly curved portion 62 of the cam member 56. The result is a slightly bowed configuration of the piston members 61 and 68 at the home position as shown. The piston members 66 and 68 are generally spaced from the contact valves 48 such that gases can flow therebetween and the inlet apertures 82 and 84 and exhaust apertures 86 and 88 are relatively unobscured. As also shown, the piston members 66 and 68, valves 48 and the interior walls 39 of the chamber 30, in this embodiment, generally establish opposing first and second combustion chambers 90 and 92.

As shown in FIG. 3, in the home position, the piston members 66 and 68 contact the walls 39 of the interior chamber 30 at the first and second end postions 34 and 36 and substantially block or prevent a flow path between the first inlet aperture 82 and second exhaust aperture 88 and the second inlet aperture 84 and first exhaust aperture 86. Once the piston members 66 and 68 are moved from the home position the barriers no longer exist. In an alternate embodiment, suitable means can be provided for a permanent barrier. In the home position, the combustion chamber 90 and 92 also generally have a first volume.

Figure 4:
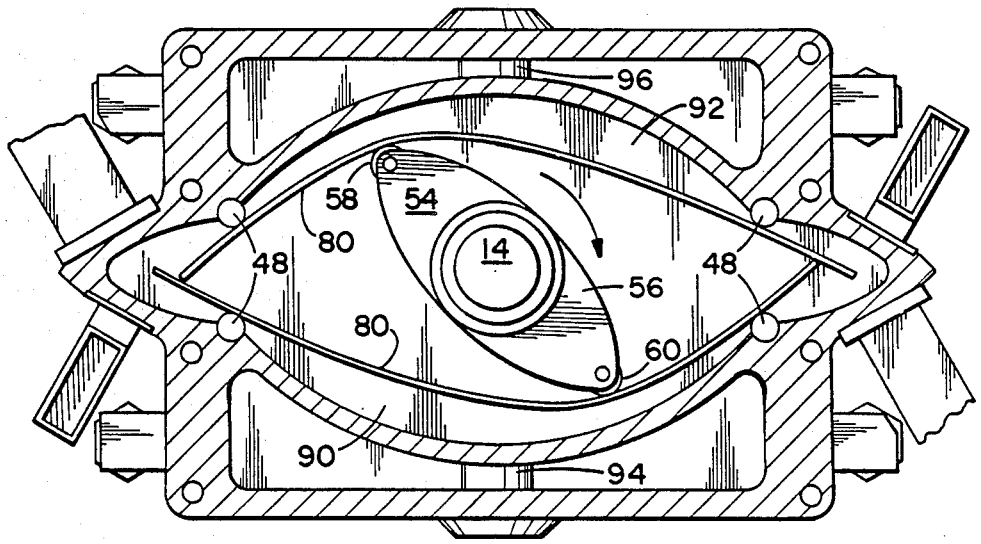
FIG. 4 is a cross-sectional view of the engine shown in FIG. 3 having the piston members and cam/crank assembly in a position between the home position and the combustion position.

Referring to FIG. 4, a diagrammatical view of the engine 10 is shown in the combustion chamber at a point in the compression cycle of the engine. As shown, the shaft 14 and cam assembly 54 have axially rotated about 45 degrees in a clockwise direction. The roller bearings 58 and 60 have contacted the second side 80 of the piston members 66 and 68, respectively, and have caused the piston members to increase their bow or flexure. The forces against the piston members cause the members to contact their respective contact valves 48 thereby sealing the two combustion chambers 90 and 92 at both the first and second chamber end portions 34 and 36. The valves 48 act as bearing pins for the piston members to flex about. Because the sides 37 and 38 of the chamber 30 are relatively flat and smooth, the piston member 66 and 68 are able to move relatively unobserved by the sides 37 and 38 except to the point of the amount of friction present because of the sealing of the piston members 66 and 68 with the chamber side 37 and 38.

Because the piston members 66 and 68 are being additionally bowed, their first ends 70 and 71 and their second ends 72 and 73 have a tendency to move towards each other. However, because the piston members 66 and 68 are being acted upon by the cam/crank assembly 54 at equal, but opposite, offset distances from the center axis of the shaft 14, the bow, at least initially, is non-symmetric for each piston member 66 and 68. The piston members 66 and 68 invertedly mirror each other which allows the first end 70 of the first piston member 66 to contact the second side 80 of the second piston member 68 and, at least partially, slide therealong. Correspondingly, the first end 71 of the second piston member 68 contacts the second side 80 of the first piston member 66 and, at least partially, slides therealong.

The first and second ends 70 and 72 of the piston members 66 and 68 being acted upon in a relatively identical, but opposite fashion, the two piston members flex in a relatively similar fashion such that neither piston member substantially interferes with the other. As the cam/crank assembly 54 continues to rotate, with the piston members 66 and 68 cooperating with the contact valves 48, the volume of the chambers 90 and 92 is decreased and the gases in the chambers 90 and 92 are compressed. Because of the length of the piston members 66 and 68 and their increasing bow, the first ends 70 and 71 eventually separate from the second sides 80 of the opposite piston member.

Figure 5:
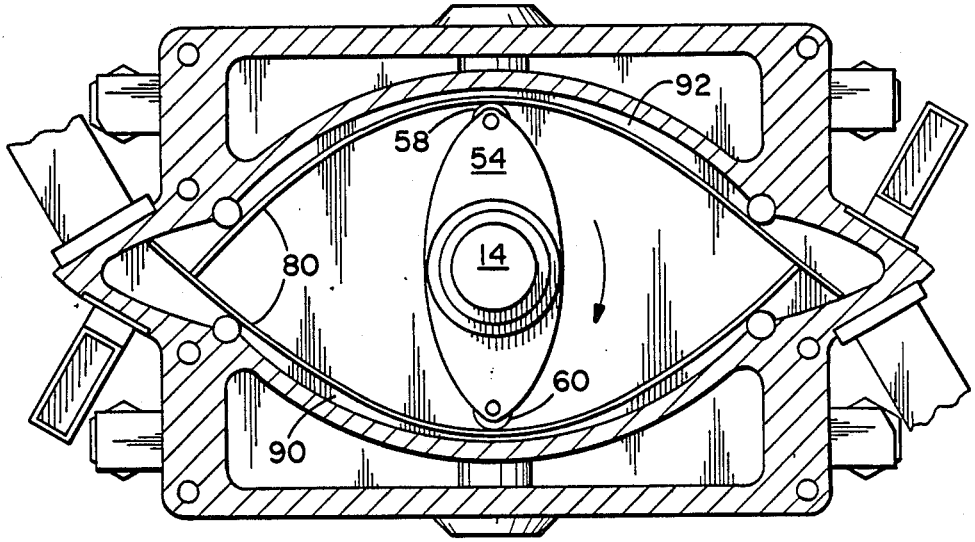
FIG. 5 is a cross-sectional view of the engine shown in FIG. 3 having the piston and cam/crank assembly in a combustion position.

Referring now to FIG. 5, the engine 10 is shown in a combustion ignition position. As shown, the shaft 14 and cam/crank assembly 54 have rotated about 90 degrees from the home position. It is important to note that the combustion ignition position can obviously vary as know in the art to allow for efficient combustion and maximum power from the combustion. As shown, the piston members 66 and 68 have been flexed to the extent that the volume of the combustion chambers 90 and 92 in relatively small with the fuel and gases in the combustion chambers having been compressed therein. The ignition means 24 can now ignite the compressed gases and fuel resulting in combustion as known in the art. Due to the clockwise motion of the cam assembly 54, the expanding combustion gases drive the piston members 66 and 68 back towards the home position and the cam assembly 54 and shaft 14 in the clockwise direction.

As the cam/crank assembly 54 continues to rotate clockwise, the piston members 66 and 68 are allowed to decrease their bow and eventually break contact with the contact valves 50. The combustion gases can now be evacuated or pushed by newly incoming fuel mixture from the combustion chambers 90 and 92. When the cam/crank assembly 54 reaches a point of 180 degrees from the home position, the piston members have returned to their home position. Thus, with only about 180 degrees of rotation of the shaft 14, or a one-half rotation, the engine has completed a two-stroke cycle per combustion chamber. Thus, the present invention allows for a one-half revolution two stroke cycle. With a full 360 degree rotation of the shaft 14, the engine can complete two two-strike cycles per combustion chamber. The combusted gases can then be evacuated or pushed out of the engine and new fuel mixture can be introduced as know in the art to provide continuous operation of the engine 10. Alternatively, the ignition means 24 or fuel system 18 can be selectively controlled to allow combustion in only one combustion chamber at a time thereby allowing only one complete two-stroke combustion cycle for each combustion chamber per cycle for each 360 degree rotation of the shaft 14. Alternatively, the combustion chambers can be offset from one another with the cam/crank assembly having individual cam portions offset from one another to thereby allow only one two-stroke cycle for each combustion chambers per one revolution of the shaft 14.

An alternate embodiment of the invention may include sealing plates located proximate the sides of the interior chamber 30 and contacting the third and forth end 74 and 76 of the piston members 66 and 68. The sealing plates can be pressed against the piston members by a suitable means such as by the use of hydraulics. Alternatively, oil can be used as the hydraulic fluid with the plate having tiny pin holes to provide lubrication to the engine. Alternating oil for lubrication can be provided between the piston members 66 and 68 in the cam assembly area provided suitable sealing is provided at the first and second end portions 34 and 36 of the interior chamber 30. In addition to the embodiments described above, the present invention may be incorporated in combination with rigid piston members, such as locating a flexible piston member on the piston head of a standard piston.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A piston system for use in an internal combustion engine comprising:

flexible piston means disposed with a combustion chamber of the engine, said piston means having at least one relatively thin flexible member with a combustion chamber surface, a drive means surface and two relatively free ends; and drive means movably disposed with said flexible piston means such that said drive means can deform said flexible piston means for the compression cycle of the engine.

2. A system as in claim 1 further comprising flexure bearing means for providing relatively fixed bearing surfaces for said flexible piston means to deflect about.

3. A system as in claim 1 wherein said flexible piston means comprises an elongate resilient metal member.

4. A system as in claim 1 wherein said drive means comprises a cam/crank means.

5. A system as in claim 4 wherein said cam/crank means comprises piston bearing means.

6. A system as in claim 1 wherein said flexible piston means comprises a variable curved piston member.

7. A system as in claim 1 wherein said flexible means is relatively elastic.

8. An internal combustion engine comprising:

housing means having a combustion chamber means, a fuel inlet means and a gas exhaust means;

drive means at least partially mounted in said housing means and having piston drive means connected thereto; and elastic piston means disposed in said housing means adjacent said combustion chamber means, said elastic piston means having at least one piston member with two relatively free ends being deformable by said piston drive means and enabling said combustion chamber means to vary in size whereby said piston drive means can vary in size whereby said piston drive means can vary the volume of said combustion chamber during the compression cycle of the engine.

9. An engine as in claim 8 wherein said elastic piston means comprises a relatively thin flexible plate.

10. An engine as in claim 8 further comprising combustion ignition means.

11. An engine as in claim 8 further comprising engine cooling means.

12. An engine as in claim 8 wherein said drive means comprises a drive shaft and said piston drive means comprises a cam means connected to said drive shaft.

13. An engine as in claim 12 wherein said cam means is relatively elliptical shaped with a bearing means for contacting said elastic piston means.

14. An engine as in claim 8 further comprising valve means.

15. An engine as in claim 14 wherein said valve means comprises piston contact valve means.

16. An engine as in claim 8 further comprising piston sealing means.

17. An engine as in claim 16 wherein said piston sealing means comprises pressure plate means disposed adjacent said elastic piston means.

18. An internal combustion engine comprising:

housing means having an internal working chamber, said chamber having a first relatively oval shaped center portion and second end portions;

fuel inlet means communicating with said second end portions;

gas exhaust means communicating with said second end portions;

flexible piston means disposed in said working chamber, said flexible piston means comprising at least two relatively thin flexible plates with each plate having two opposite end portions located within said chamber second end portions;

cam shaft means rotatably mounted in said working chamber between said two plates and being capable of deforming said plates; and piston contact valve means located proximate said plates in said chamber between said center portion and said end portions of said chamber.

19. A piston system for use in an internal combustion engine comprising:

a flexible piston means disposed with a combustion chamber of an engine, said piston means comprising at least two relatively thin flexible plates, each of said plates being disposed proximate a separate combustion chamber of an engine; and drive means movably disposed between said two plates such that said drive means can deform said plates for the compression cycle of an engine.

20. An internal combustion engine comprising:

housing means having an internal working chamber, said chamber having a first relatively oval shaped center portion and second end portions;

flexible piston means disposed in said working chamber, said flexible piston means comprising at least two relatively thin flexible plates with each plate having two opposite end portions located with said chamber second end portions; and cam shaft means rotatably mounted in said working chamber between said two plates and being capable of deforming said plates.

21. An engine as in claim 20 wherein said cam shaft means has a generally oval shaped member and roller bearing means.

* * * * *